US011459879B2

(12) United States Patent
Macpherson

(10) Patent No.: US 11,459,879 B2
(45) Date of Patent: Oct. 4, 2022

(54) MUD PULSE TRANSMISSION TIME DELAY CORRECTION

(71) Applicant: John Macpherson, Spring, TX (US)

(72) Inventor: John Macpherson, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/004,718

(22) Filed: Aug. 27, 2020

(65) Prior Publication Data

US 2021/0062644 A1 Mar. 4, 2021

Related U.S. Application Data

(60) Provisional application No. 62/892,898, filed on Aug. 28, 2019.

(51) Int. Cl.
*E21B 47/18* (2012.01)
*E21B 47/06* (2012.01)

(52) U.S. Cl.
CPC ..... *E21B 47/18* (2013.01); *E21B 47/06* (2013.01)

(58) Field of Classification Search
CPC ..... E21B 47/18; E21B 47/06
See application file for complete search history.

(56) References Cited

U.S. PATENT DOCUMENTS 4,733,233 A * 3/1988 Grosso ..... E21B 21/08 367/82
5,812,068 A 9/1998 Wisler et al.
6,308,562 B1 * 10/2001 Abdallah ..... E21B 47/18 73/152.18
6,923,052 B2 8/2005 Krueger et al.
7,324,010 B2 1/2008 Gardner et al.
7,477,161 B2 1/2009 Macpherson et al.
7,573,397 B2 8/2009 Petrovic et al.
7,913,773 B2 3/2011 Li et al.
8,009,510 B2 8/2011 Chang
8,009,511 B2 8/2011 Hentati
8,174,404 B2 5/2012 Hahn et al.
(Continued)

FOREIGN PATENT DOCUMENTS

EP 1488073 B2 1/2012
GB 2361789 A 10/2001
WO 0111191 A1 2/2001

OTHER PUBLICATIONS

Shao et al. "Differential signal extraction for continuous wave mud pulse telemetry", Journal of Petroleum Science and Engineering 148 (2017) 127-130.

(Continued)

*Primary Examiner* — Brad Harcourt
(74) *Attorney, Agent, or Firm* — Cantor Colburn LLP

(57) ABSTRACT

Methods and systems for performing borehole operations are described. The methods include generating an information signal in a borehole using a pulse generation member, wherein the information signal comprises a pressure variation within a borehole fluid, detecting, in the borehole, a first signal that correlates to the information signal at a first time, detecting, in the borehole, a second signal that correlates to the information signal at a second time, and performing a borehole operation using the first signal and the second signal.

22 Claims, 4 Drawing Sheets

(56) References Cited

U.S. PATENT DOCUMENTS

| | | | | |
|---|---|---|---|---|
| 8,474,548 | B1 | 7/2013 | Young et al. | |
| 8,547,245 | B2 | 10/2013 | Petrovic et al. | |
| 8,749,399 | B2 | 6/2014 | Petrovic et al. | |
| 9,004,195 | B2 | 4/2015 | Regener et al. | |
| 9,007,232 | B2 | 4/2015 | Brooks | |
| 9,133,708 | B2 | 9/2015 | Conn et al. | |
| 9,528,371 | B2 | 12/2016 | Liu et al. | |
| 2007/0201308 | A1 | 8/2007 | Wassermann et al. | |
| 2016/0265351 | A1* | 9/2016 | Gajji | E21B 47/18 |
| 2017/0342823 | A1* | 11/2017 | Shah | E21B 47/095 |
| 2017/0343694 | A1 | 11/2017 | Kraft | |
| 2018/0003044 | A1 | 1/2018 | Kusuma et al. | |
| 2020/0040723 | A1* | 2/2020 | Miller | E21B 47/24 |

OTHER PUBLICATIONS

Spracklen, et al.: "Advanced Data Communications for Downhole Data Logging and Control Applications in the Oil ndustry"; IOP Conf. Series: Materials and Engineering 51 (2013), 6 pages.

* cited by examiner

MUD PULSE TRANSMISSION TIME DELAY CORRECTION

CROSS REFERENCE TO RELATED APPLICATIONS

This application claims the benefit of an earlier filing date from U.S. Provisional Application Ser. No. 62/892,898, filed Aug. 28, 2019, the entire disclosure of which is incorporated herein by reference.

BACKGROUND

1. Field of the Invention

The present invention generally relates to subsurface operations and more particularly to mud pulse transmissions and time delays thereof.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to energy or a material (e.g., heat, a gas, or fluid) contained in a formation located below the earth's surface. Different types of tools and instruments may be disposed in the boreholes to perform various tasks and measurements.

Data collected downhole must be transmitted to the surface for processing. Various mechanisms for data transmission are known in the art. One example method for data transmission is mud-pulse telemetry. During such data transmissions, a pulser is employed to generate a pressure wave that travels through the drilling fluid and is detected at a surface unit. The surface unit may then extract the data from the pressure waves. Pressure waves travel through a medium at a limited speed, and, as such, a delay will exist between when the data is transmitted and when the data is received. Typically, this delay is calculated based on various factors including an estimation of the travel speed of the pressure wave through the drilling fluid.

SUMMARY

Disclosed herein are methods and downhole systems for performing borehole operations. The methods include generating an information signal in a borehole using a pulse generation member, wherein the information signal comprises a pressure variation within a borehole fluid, detecting, in the borehole, a first signal that correlates to the information signal at a first time, detecting, in the borehole, a second signal that correlates to the information signal at a second time, and performing a borehole operation using the first signal and the second signal.

The downhole systems include a downhole assembly disposed in a borehole, a pulse generation member disposed on the downhole assembly and configured to generate an information signal, wherein the information signal comprises a pressure variation within a borehole fluid, a pressure sensor arranged on the downhole assembly and configured to detect a first signal that correlates to the information signal at a first time and a second signal that correlates to the information signal at a second time, and a processor configured to estimate data indicative of a transmit time, the data indicative of the transmit time estimated by using the first signal and the second signal.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
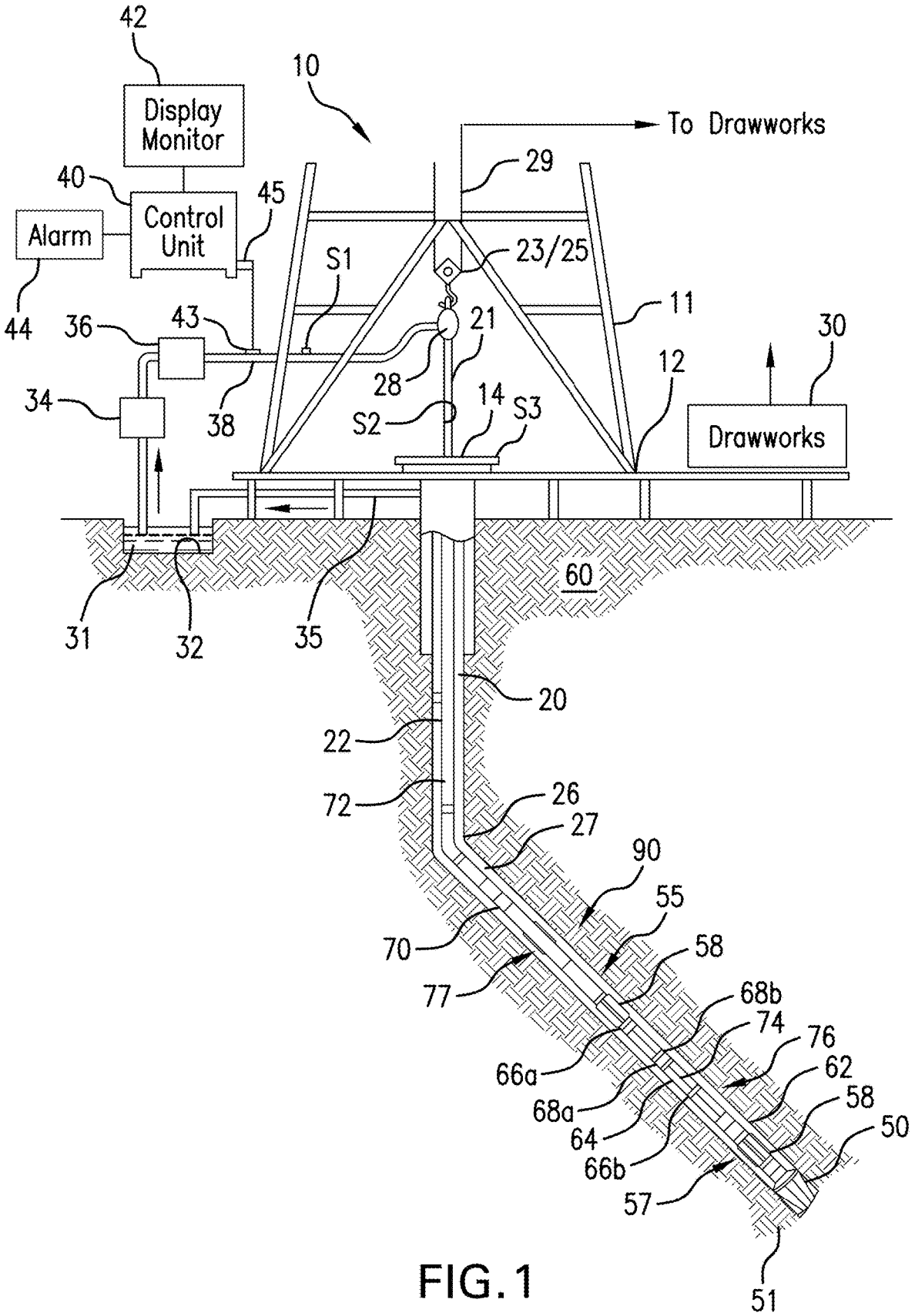
FIG. 1 is an example of a system for performing subsurface operations that can employ embodiments of the present disclosure.

FIG. 1 shows a schematic diagram of a system for performing subsurface operations (e.g., downhole, within the earth or below other surface and into a formation). Although FIG. 1 described herein provides a specific configuration for a drilling system, various other configurations are possible without departing from the scope of the present disclosure. That is, FIG. 1 and the description thereof is provided merely for illustrative and explanatory purposes, and is not intended to be limiting in any way.

As shown, the system is a drilling system 10 that includes a drill string 20 having a drilling assembly 90, also referred to as a bottomhole assembly (BHA), conveyed in a borehole or borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drill pipe 22 or drilling tubular extending downward from the rotary table 14 into the borehole 26. A disintegrating device 50, such as a drill bit attached to the end of the drilling assembly 90, disintegrates the geological formations when it is rotated to drill the borehole 26. The drill string 20 is coupled to a drawworks 30 via a kelly joint 21, swivel 28, traveling block 25, and line 29 through a pulley 23.

During the drilling operations, the drawworks 30 is operated to control the weight-on-bit (WOB), which affects the rate of penetration. The operation of the drawworks 30 is well known in the art and is thus not described in detail herein. Alternatively, the drilling string may be referred to as a downhole string comprising a downhole assembly. Instead of a drill string, another type of downhole string may be utilized, such as a completions string, a logging string, a workover string, a fishing string, and a re-entry string.

During a downhole operation, such as a drilling operation, a suitable downhole fluid 31, such as drilling fluid (also referred to as "mud"), may be provided from a source 32 (e.g., a mud pit) and is circulated under pressure through the drill string 20 by a pump 34 (e.g., a mud pump). The drilling fluid 31 passes into the drill string 20 via a desurger 36, fluid line 38 and the kelly joint 21. Fluid line 38 may also be referred to as a mud supply line. The drilling fluid 31 is discharged at the borehole bottom 51 through an opening in the disintegrating device 50. The drilling fluid 31 circulates uphole through the annular space 27 between the drill string 20 and the borehole 26 and returns to the mud pit 32 via a return line 35. In some embodiments, an optional sensor S1 in the fluid line 38 provides information about the fluid flow rate. In other embodiments, inlet flow rate may be calculated from a pump rate, and an outlet flow rate may be monitored by a sensor in the return line 35. A surface torque sensor S2 and a rotational speed sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the drilling assembly 90.

In some applications the disintegrating device 50 is rotated by rotating the drill pipe 22. However, in other applications, a drilling motor 55 (such as a mud motor) disposed in the drilling assembly 90 is used to rotate the disintegrating device 50 and/or to superimpose or supplement the rotation of the drill string 20. In either case, the rate of penetration (ROP) of the disintegrating device 50 into the formation 60 for a given formation and a drilling assembly largely depends upon the weight-on-bit and the rotational speed of the disintegrating device 50. In one aspect of the embodiment of FIG. 1, the drilling motor 55 is coupled to the disintegrating device 50 via a drive shaft (not shown) disposed in a bearing assembly 57. If a mud motor is employed as the drilling motor 55, the mud motor rotates the disintegrating device 50 when the drilling fluid 31 passes through the drilling motor 55 under pressure. The bearing assembly 57 supports the radial and axial forces of the disintegrating device 50, the downthrust of the drilling motor and the reactive upward loading from the applied weight-on-bit. Stabilizers 58 coupled to the bearing assembly 57 and at other suitable locations on the drill string 20 act as centralizers, for example for the lowermost portion of the drilling motor assembly and other such suitable locations.

A surface control unit 40 receives signals from the downhole sensors 70 and devices via a pressure sensor 43 placed in the fluid line 38 as well as from sensors S1, S2, S3, hook load sensors, sensors to determine the height of the traveling block (block height sensors), and any other sensors used in the system and processes such signals according to programmed instructions provided to the surface control unit 40 (i.e., a surface unit). For example, a surface depth tracking system may be used that utilizes the block height measurement to determine a length of the borehole (also referred to as measured depth of the borehole) or the distance along the borehole from a reference point at the surface to a predefined location on the drill string 20, such as the disintegrating device 50 or any other suitable location on the drill string 20 (also referred to as measured depth (MD) of that location, e.g. measured depth of the disintegrating device 50).

Determination of measured depth at a specific time may be accomplished by adding the measured block height to the sum of the lengths of all equipment that is already within the borehole at the time of the block-height measurement, such as, but not limited to drill pipes 22, drilling assembly 90, and disintegrating device 50. Depth correction algorithms may be applied to the measured depth to achieve more accurate depth information. Depth correction algorithms, for example, may account for length variations due to pipe stretch or compression due to temperature, weight-on-bit, borehole curvature and direction.

By monitoring or repeatedly measuring block height, as well as lengths of equipment that is added to the drill string 20 while drilling deeper into the formation over time, pairs of time and depth information are created that allow estimation of the depth of the borehole 26 or any location on the drill string 20 at any given time during a monitoring period. Interpolation schemes may be used when depth information is required at a time between actual measurements. Such devices and techniques for monitoring depth information by a surface depth tracking system are known in the art and therefore are not described in detail herein.

The surface control unit 40 displays desired drilling parameters and other information on a display/monitor 42 for use by an operator at the rig site to control the drilling operations. The surface control unit 40 contains a computer that may comprise memory for storing data, computer programs, models and algorithms accessible to a processor in the computer, a recorder, such as optical data storage, memory unit, etc. for recording data and other peripherals. The surface control unit 40 also may include simulation models for use by the computer to process data according to programmed instructions. The control unit responds to user commands entered through a suitable device, such as a keyboard. The control unit 40 can output certain information through an output device, such as a display, a printer, an acoustic output, etc., as will be appreciated by those of skill in the art. The control unit 40 is adapted to activate alarms 44 when certain unsafe or undesirable operating conditions occur.

The drilling assembly 90 may also contain other sensors and devices or tools for providing a variety of measurements relating to the formation 60 surrounding the borehole 26 and for drilling the borehole 26 along a desired path. Such devices may include a device for measuring formation properties, such as the formation resistivity, formation acoustic properties, formation nuclear properties, or the formation gamma ray intensity around the borehole 26, near and/or in front of the disintegrating device 50 and devices for determining the inclination, azimuth and/or position of the drill string. A logging-while-drilling (LWD) device for measuring formation properties, such as a formation resistivity tool 64 or a gamma ray device 76 for measuring the formation gamma ray intensity, made according an embodiment described herein may be coupled to the drill string 20 including the drilling assembly 90 at any suitable location. For example, coupling can be above a lower kick-off subassembly 62 for estimating or determining the resistivity of the formation 60 around the drill string 20 including the drilling assembly 90. Another location may be near or in front of the disintegrating device 50, or at other suitable locations. A directional survey tool 74 that may comprise means to determine the direction of the drilling assembly 90 with respect to a reference direction (e.g., magnetic north, vertical up or down direction, etc.), such as a magnetometer, gravimeter/accelerometer, gyroscope, etc. may be suitably placed for determining the direction of the drilling assembly, such as the inclination, the azimuth, and/or the toolface of the drilling assembly. Any suitable direction survey tool may be utilized. For example, the directional survey tool 74 may utilize a gravimeter, a magnetometer, or a gyroscopic device to determine the drill string direction (e.g., inclination, azimuth, and/or toolface). Such devices are known in the art and therefore are not described in detail herein.

Direction of the drilling assembly may be monitored or repeatedly determined to allow for, in conjunction with depth measurements as described above, the determination of a borehole trajectory in a three-dimensional space. In the above-described example configuration, the drilling motor 55 transfers power to the disintegrating device 50 via a shaft (not shown), such as a hollow shaft, that also enables the drilling fluid 31 to pass from the drilling motor 55 to the disintegrating device 50. In alternative embodiments, one or more of the parts described above may appear in a different order, or may be omitted from the equipment described above.

Still referring to FIG. 1, other LWD devices (generally denoted herein by numeral 77), such as devices for measuring rock properties or fluid properties, such as, but not limited to, porosity, permeability, density, salt saturation, viscosity, permittivity, sound speed, nuclear magnetic resonance parameters, resistivity, etc. may be placed at suitable locations in the drilling assembly 90 for providing information useful for evaluating the subsurface formations 60 or fluids along borehole 26. Such devices may include, but are not limited to, resistivity tools, acoustic tools, nuclear tools, nuclear magnetic resonance tools, permittivity tools, and formation testing and sampling tools.

The above-noted devices may store data to a memory downhole and/or transmit data to a downhole telemetry system 72, which in turn transmits the received data uphole to the surface control unit 40. The downhole telemetry system 72 may also receive signals and data from the surface control unit 40 and may transmit such received signals and data to the appropriate downhole devices. In one aspect, a mud pulse telemetry system may be used to communicate data between the downhole sensors 70 and devices and the surface equipment during drilling operations. A pressure sensor 43 placed in the fluid line 38 may detect mud pressure variations, as mud pulses responsive to the data transmitted by the downhole telemetry system 72. Sensor 43 may generate signals (e.g., electrical signals) in response to the mud pressure variations and may transmit such signals via a conductor 45 (electrical or optical) or wirelessly to the surface control unit 40. In other aspects, any other suitable telemetry system may be used for one-way or two-way data communication between the surface and the drilling assembly 90, including but not limited to, an acoustic telemetry system, an electro-magnetic telemetry system, a wired pipe, or any combination thereof. The data communication system may utilize repeaters in the drill string or the borehole. One or more wired pipes may be made up by joining drill pipe sections, wherein each pipe section includes a data communication link that runs along the drill pipe. The data connection between the drill pipe sections may be made by any suitable method, including but not limited to, electrical or optical line connections, including optical, induction, capacitive or resonant coupling methods. A data communication link may also be run along a side of the drill string 20, for example, if coiled tubing is employed.

The drilling system described thus far relates to those drilling systems that utilize a drill pipe to convey the drilling assembly 90 into the borehole 26, wherein the weight-on-bit is controlled from the surface, typically by controlling the operation of the drawworks. However, a large number of the current drilling systems, especially for drilling highly deviated and horizontal boreholes, utilize coiled-tubing for conveying the drilling assembly subsurface. In such application a thruster is sometimes deployed in the drill string to provide the desired force on the disintegrating device 50. Also, when coiled-tubing is utilized, the tubing is not rotated by a rotary table but instead it is injected into the borehole by a suitable injector while a downhole motor, such as drilling motor 55, rotates the disintegrating device 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling or casing drilling can be one configuration or operation used for providing a disintegrating device that becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole During a Single Trip," which is incorporated herein by reference in its entirety. Importantly, despite a relatively low rate of penetration, the time of getting a liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the drill pipe or drill string will get stuck due to hole collapse.

One or more sensors of the systems may be configured to sense amplitudes of vibrations or oscillations over time may be disposed on the drill string or the BHA. In one or more embodiments, one or more vibration sensors (e.g., acceleration sensors, gravitation sensors, etc.) may be disposed near the drill bit or disintegrating device so as to sense vibrations or oscillations at a point of excitation of the drill string. The drill bit may be considered a point of excitation due to interaction of the drill bit with a formation rock as the formation rock is being drilled. Alternatively, or in addition thereto, one or more sensors may be configured to sense torque. Sensed data from one or more torque sensors may be transmitted to a surface receiver or a surface computer processing system for processing. Alternatively, or in addition thereto, sensor data may be processed downhole by downhole electronics, which may also provide an interface with a telemetry system.

Although FIG. 1 is shown and described with respect to a drilling operation, those of skill in the art will appreciate that similar configurations, albeit with different components, can be used for performing different subsurface operations. For example, a top-drive may be used to rotate the drill string on surface, rather than a kelly and rotary table, and further, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired subsurface operation(s).

Figure 2:
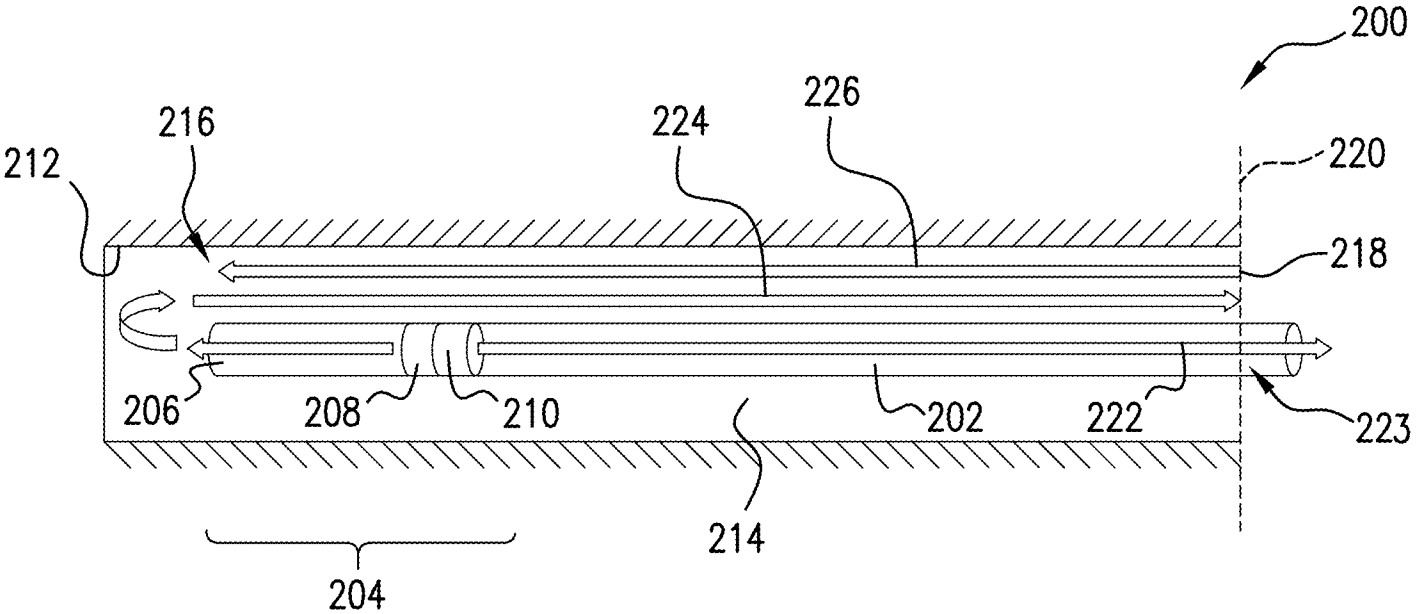
FIG. 2 is a schematic illustration of a downhole system for performing a telemetry operation in accordance with an embodiment of the present disclosure.

Turning now to FIG. 2, a schematic illustration of a portion of a downhole telemetry system 200 in accordance with an embodiment of the present disclosure is shown. The downhole telemetry system 200 includes a drill string 202 having a bottomhole assembly 204. The bottomhole assembly 204 includes a disintegrating device 206, a pressure sensor module 208, and a pulse generation member such as a pulser 210, also referred to as a mud pulser or downhole pulser. The pulser and the pressure sensor module do not have to be in the same location. For example, the pressure sensor module may be located within the drill string outside of the BHA, while the pulser may be located within the BHA. If the pulser and the pressure sensor are at a distance, the estimated travel time has to be corrected for that distance. Any type of pulse generation member may be used such as, but not limited to, a poppet valve, a shear valve (e.g., an oscillating shear valve), a mud siren, etc. The drill string 202 is disposed within a borehole 212. Drilling fluid 214 is pumped downhole through the interior of the drill string 202 to drive operation of the disintegrating device 206. The drilling fluid 214 will exit the disintegrating device 206 and enter into an annulus 216 of the borehole 212 (i.e., a space between the exterior of the drill string 202 and a wall of the borehole 212). The drilling fluid 214 within the annulus 216 of the borehole 212 will fill the borehole 212 to a fluid top 218 (or borehole top), which may be proximate the earth surface 220.

During drilling operations, mud-pulse telemetry may be employed to transmit information from downhole (e.g., at the pulser 210) to the surface 220 (e.g., to a surface control unit). The pulser will generate pressure or flow variations in the drilling fluid. The pressure or flow variations are modulated to contain information. Various modulation schemes can be used, as known in the art. For example, without limitation, modulation schemes can include amplitude shift keying, phase shift keying, and frequency shift keying. By modulating the pressure or flow variations, bits, bytes, words, etc. will be formed that include the information. The information may also contain compression and/or error correction data, as needed. The information received at the surface 220 may be analyzed to obtain downhole data collected by one or more sensors and/or devices located downhole (e.g., components of the bottomhole assembly 204). The pulser 210 is configured to generate mud pulses in the form of pressure waves within the drilling fluid 214. An information signal 222 is transmitted through the drilling fluid 214 from the pulser 210 upward or downward through the drill string 202. The information signal 222 is a mud pulse or pressure pulse transmitted through the drilling fluid 214 as generated by the pulser 210. The pulser 210 generates a mud pulse telemetry stream that includes data to be analyzed at the surface 220 (i.e., at a surface control unit). That is, the information signal 222 includes the downhole data.

A mud pulse telemetry stream, as generated by the pulser 210, is essentially a sequence of information symbols in the form of pressure pulses. The information symbols make up the information signal. For example, in one information-encoding scheme, a positive pulse may represent binary digit 1, while the absence of a pulse may represent the binary digit 0. In yet another information-encoding scheme, the binary digits may depend on the position of positive pulses with time. Because the sequence of pressure pulses depends on the data being transmitted, which varies with time, the sequence of pressure pulses is pseudo-random. The mud pulse telemetry stream travels to the surface via a drill string bore 223 (i.e., internal to the drill string) in the form of the information signal 222. The pulses will also travel in the reverse direction, downhole toward and through the disintegrating device 206 and up the annulus 216. The stream in the annulus 216 has a first annulus signal 224 that travels uphole through the annulus 216 from the disintegrating device 206 toward the surface 220. When the first annulus signal 224 contacts the fluid top 218, the pulses will reflect and travel back downhole as a second annulus signal 226. The fluid top acts as a reflector for pressure pulses in the borehole. Alternatively, the pulses will be received by a pressure sensor or a flow sensor at the surface (such as sensor 43 in FIG. 1), processed (e.g., amplified) and the pulses or a different pulse sequence will be sent back downhole. The original pulses, the reflection, as well as the active re-sending of the pulses or a processed or different pulse sequence are all meant by the expression "correlating to the information signal" within this disclosure. The pulses detected at the pressure sensor or flow sensor at the surface are referred to as measured surface pressure signals.

Embodiments of the present disclosure are directed to measuring the two-way travel time of the annulus signal (224, 226) or pressure pulse stream. The two-way travel time can provide a measurement of the average pressure wave speed. That is, the two-way travel time can be used to determine the speed at which the pressure pulses generated by the pulser 210 travel through the drilling fluid 214. This information can be used to determine a communication channel delay, or a delay in time from generation of the information signal 222 at the pulser 210 and receipt of the information signal 222 at the surface 220 (or surface equipment). The measured delay can be used to synchronize downhole and surface clocks and measurements.

To measure the annulus signals 224, 226, the pressure sensor module 208 is arranged in the bottomhole assembly 204 (or otherwise along the drill string 202). The pressure sensor module 208 is configured such that a portion is exposed to an exterior of the drill string 202, or is exposed to the drilling fluid 214 within the annulus 216 of the borehole 212. The pressure sensor module 208 can include one or more pressure sensors arranged to measure fluid pressure. In one non-limiting embodiment, the pressure sensor module 208 includes a first pressure sensor arranged to measure a fluid pressure within a bore of the drill string 202 and a second pressure sensor is arranged to measure a fluid pressure within the annulus 216. The pressure sensor module 208 is arranged to measure, and detect, changes in pressure within the drilling fluid 214, both in the annulus 216 and within the drill string bore 223. As such, the pressure sensor module 208 may be a pressure sensor module that includes one or more detectors arranged to detect and measure a fluid pressure at both the interior of the drill string 202 and the exterior of the drill string 202. Accordingly, a first pressure measurement may be made of the bore pressure (first measured bore pressure signal) within the drill string bore 223. A second pressure measurement may be made in the annulus 216 on the exterior of the drill string 202 (first measured annulus pressure signal). Further, a third pressure measurement may be made in the annulus 216 on the exterior of the drill string 202 (second measured annulus pressure signal). Before processing the measured annulus pressure signal(s) and the measured bore pressure signal(s), the measured signals may undergo a signal conditioning, such as amplification, noise reduction, filtering, and/or analog-digital conversion (A/D converter).

As used in this disclosure, the terms annulus signal, bore signal, and/or information signal refer to a sequence of pressure variations over time. The pressure variations may be discrete pressure pulses or a continuous (non-discrete) pressure variation over time, created by a mud pulser or other type of mud pressure modulator. A pressure sensor in the annulus, in the bore of the drill string, or at a surface location may be configured to detect the pressure variation and translate the detected pressure variation into a measured annulus pressure signal, a measured bore pressure signal, or a measured surface pressure signal, respectively. The measured annulus pressure signal, the measured bore pressure signal, and/or the measured surface pressure signal may be electrical, electromagnetic, or optical signals. In some embodiments of the present disclosure, the bore pressure sensor and the annulus pressure sensor may be in different pressure sensor modules. The bore pressure sensor may be located or positioned at a different axial location along the drill string as the annulus pressure sensor. The term axial, as used herein, refers to the longitudinal axis of the drill string. In some embodiments, the first annulus signal and the second annulus signal may be detected by only one annulus pressure sensor (i.e., the same annulus pressure sensor is used for both the first and second annulus signals). In other embodiments, a first annulus pressure sensor and a second annulus pressure sensor may be arranged to obtain respective measured annulus pressure signals. In some such embodiments, the first annulus pressure sensor and the second annulus pressure sensor may be located at the same axial location of the drill string or at different axial locations of the drill string. Because the annulus pressure is the same at every circumferential location at a given axial location in the annulus, every circumferential location of the annulus pressure sensor in the drill string is possible. The same holds true for the bore pressure sensor(s). In some embodiments, there may be more than one bore pressure sensor and/or more than two annulus pressure sensors in the drill string providing measured bore pressure signals and measured annulus pressure signals.

In operation, the first and second measurements are made of the fluid pressure within the drill string bore 223 and within the annulus 216, at a location downhole. When the pulser 210 is operating, the first pressure measurement (within the drill string bore 223) the measured bore pressure signal, and a second pressure measurement (within the annulus 216), the measured annulus pressure signal, are cross-correlated to look for correlation peaks. Because the sequence of pulses is pseudo-random, if the first pressure measurement and the second pressure measurement are mathematically correlated, a maximum in the correlation occurs when the data packet encoded in the information signal generated by the pulser 210 is measured by the first pressure measurement, and by the second pressure measurement. In a mathematical correlation, similarities are determined on two signals as a function of displacement of one signal relative to the other signal. In this disclosure, the displacement is a shift in time. The correlation detects certain signal pattern(s) appearing on both of the correlated signals.

In accordance with embodiments of the present disclosure, a certain signal pattern is caused by a pressure variation pattern (pressure pulse pattern) created by the mud pulser while generating the information signal. The information signal comprises downhole data. As downhole data changes with time, a sequence of downhole data creates signal patterns that change with time. It is extremely unlikely that a sequence of downhole data will repeat. A repeated sequence of downhole data requires the earth formation not to change, the operational conditions not to change, and the noise on the data not to change. Therefore, the information signal created by the mud pulser is considered pseudo-random comprising pseudo-random information signal patterns.

While an information signal pattern travels through the drill string bore 223 and the annulus 216, the bore pressure sensor and the annulus pressure sensor will detect the information signal pattern at different times, depending on the distance to the mud pulser and the transmission velocity of the information signal in the fluid. The information signal pattern in the annulus and the information signal pattern in the bore is what is referred here to as annulus signal and bore signal. A specific information signal pattern created by the mud pulser passes the bore pressure sensor on its way down to the drill bit, enters the annulus and travels uphole, passes the annulus pressure sensor, travel to the fluid top where it is reflected, travels downward, and passes the annulus pressure sensor a second time. The travel time from the annulus pressure sensor to the fluid top and back to the annulus pressure sensor can be determined by: (i) cross-correlating the measured bore pressure signal with the measured annulus pressure signal; (ii) auto-correlating the annulus pressure signal; (iii) in the case of first and second annulus pressure sensors, by cross-correlating the measured bore pressure signal with the first measured annulus pressure signal and with the second measured annulus pressure signal; and (iv) cross-correlating the first measured annulus pressure signal and the second measured annulus pressure signal. Other correlations are possible depending on different number of bore pressure and/or annulus pressure sensors. A maximum amplitude in the correlation occurs at a displacement (time shift) of the correlated measured pressure sensor signals at which a certain information signal pattern on the two correlated measured pressure signals correlates.

The pulser 210 generates the information signal 222 to be transmitted to the surface 220 for analysis, and the information signal 222 is measured within the first pressure measurement. The first pressure measurement provides the measured bore pressure signal below the mud pulser. This measured bore pressure signal is acquired by a bore pressure sensor located at any location in the bore below the mud pulser.

The second pressure measurement will detect the first annulus signal 224 (providing the first measured annulus pressure signal), and the third measurement will detect the second annulus signal 226 (providing the second measured annulus pressure signal). The first measured annulus pressure signal (i.e., caused by the up travelling wave) will correlate with the measured bore pressure signal at a first time $t_1$ or at a first time shift $\tau_1$ and the second measured annulus pressure signal (i.e., caused by the down travelling wave) will correlate with the measured bore pressure signal at a second (larger) time $t_2$ or at a second time shift $\tau_2$. The difference between the first time $t_1$ and the second time $t_2$, or the difference between the first time shift $\tau_1$ and the second time shift $\tau_2$, is the two-way travel time of the information signal (pressure pulses) traveling through the drilling fluid 214. The two-way travel time can be used to determine a time delay in receiving the information signal 222 at the surface 220, and thus time-synchronization may be achieved.

The time delay and/or synchronization may be used in correcting for transmission delays of data packets to the surface from the pulser 210. The two-way travel time and/or a measured time delay (i.e., half the two-way travel time) may be transmitted in a data packet to the surface from the pulser 210 (i.e., within a mud pulse and as information signal). Using the time delay information, time-stamps of the data packet or other transmitted information (e.g., information signal 222) can be corrected for synchronization with other data sources and to account for the time delay in travel time of pressure pulses from the pulser 210 to the surface 220. For example, using the time delay information, time-stamps of transmitted data, such as logging-while-drilling data (e.g., formation evaluation data (FE data), such as gamma, resistivity, acoustic, NMR, or similar data measured by a formation evaluation sensor) or measurement-while-drilling data (MWD data) (e.g., dynamic data or survey data, such as azimuth, inclination, or toolface data) can be corrected for time synchronization with a depth acquisition system and to account for the time delay in travel time from the pulser 210 to the surface 220 when processing the data (e.g., when assigning the data encoded in the information signal to a depth, such as the depth where it was acquired).

The borehole depth of downhole acquired data is determined by the time when the downhole data was measured. The depth acquisition system provides a depth at a specific time. The depth acquisition system uses the length of the downhole string below the surface 220 at a specific time. The downhole data received at the surface will be assigned a time stamp based on when the downhole data is received at a control unit (e.g., control unit 40 of FIG. 1). To account for transmission delays, corrections are applied on the time stamp. The corrections are based on assumptions on the time delay caused by the transmission from downhole to surface (e.g., mud system, length of drill string). Based on the corrected time stamp, a depth can be assigned based on the depth acquired by the depth acquisition system. The better the time delay correction, the more accurate the depth assignment and the better the depth-correlation of different data sets and the more accurate the location of formation features in the drilled borehole. A measured time delay for an information signal from the pulser to the surface pressure sensor(s) (e.g., surface pressure sensor 43 in FIG. 1), as provided for by embodiments of the present disclosure, allows for a better time correction than applying assumed theoretical time correction factors.

As noted above, an aspect of the present process is the use of random or pseudo-random sequences in the telemetry operation. The random or pseudo-random sequences enable the detection of the same pulse sequence passing the pressure sensor module 208 in the annulus 216 when traveling up-hole (first annulus signal 224) and within the reflected signal traveling down-hole through the annulus 216 (second annulus signal 226). The pseudo-random pulse sequences are typical of pulse-position modulation where the pulse spacing depends on the data and modulation technique. It is noted that periodic-type telemetry (such as continuous sine-wave generators) are not suited to such a technique because they do not have a well-defined autocorrelation signatures. This would make it difficult to detect the reflected signal.

In accordance with embodiments of the present disclosure the downhole-to-surface time synchronization is:

$$MT=TS-TP-TX-TD \quad (1)$$

In Equation (1), MT is a synchronized measurement time, TS is the time-stamp assigned at the surface, TP is the time taken to process the measurement data on the surface (e.g., demodulate, decode, unpack), TX is the time taken to transmit the measurement from downhole to the surface, and TD is the time taken to process the measurement data downhole (e.g., pack, encode, modulate).

The present disclosure describes a process for determining the transmit time TX. The transmit time TX, is the time delay for a signal to travel from a pulser downhole to a surface unit receiving the signal (e.g., the information signal 222). The transmit time TX depends on, for example, depth, compressibility of the drilling fluid, temperature, and pressure gradients. Typically, the transmit time TX is estimated, based on the above factors. For example, the speed of transmission can be as high as 1500 m/s in water, but in compressible fluids or mud of another composition (e.g., oil-based mud or synthetic mud) it can fall significantly to below 1,000 m/s, thus significantly impacting the transmit time TX. However, in accordance with embodiments of the present disclosure, because the transmit time TX is directly measured, the uncertainty introduced by the prior estimation can be eliminated, resulting in more accurate time data and synchronization in downhole operations.

Figure 3:
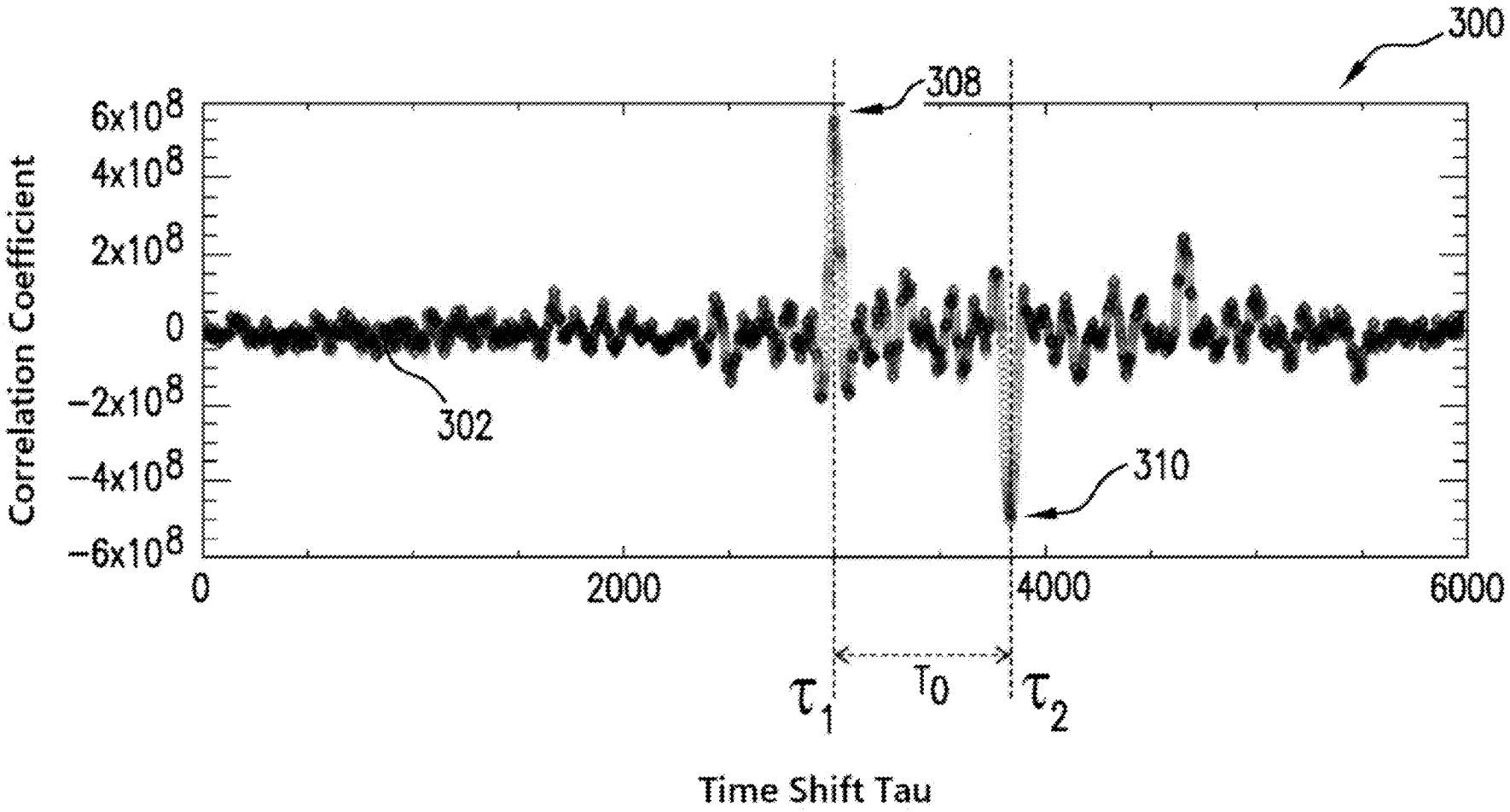
FIG. 3 is an illustrative plot of an autocorrelation of annulus pressure information collected in accordance with a non-limiting example of an embodiment of the present disclosure.

Turning now to FIG. 3, a schematic plot 300 of the cross-correlation 302 of a measured annulus pressure signal with a measured bore pressure signal as measured by a pressure sensor module in accordance with an embodiment of the present disclosure is shown. The cross-correlation 302 represents the mathematical correlation of pressure detected by a pressure sensor within the annulus of a downhole system, with the pressure detected by a pressure sensor within a bore of the drill string, in accordance with an embodiment of the present disclosure, such as that shown and described with respect to FIG. 2. The x-axis of the correlation refers to a time shift tau ($\tau$) or an absolute time (t). The unit of the time shift ($\tau$) and the absolute time (t) may be milliseconds [ms] or seconds [s]. Alternatively, the x-axis refers to a sample number n and is unitless. The y-axis of the correlation refers to a correlation coefficient (unitless). Alternatively, the y-axis refers to a variable with a unit pressure to the power of 2 [$kPa^2$].

For a mathematical correlation of a measured annulus pressure signal and a measured bore pressure signal, signal traces (e.g., timely limited sequences of a measured signal or, alternatively, number of signal samples) are used. A measured annulus pressure signal trace and a measured bore pressure signal trace may cover the same time interval (e.g., a trace may be 10 s long), but do not necessarily need to be the same. A measured annulus pressure signal trace may cover a different time interval as a measured bore pressure signal trace (e.g., the measured annulus pressure signal trace may cover a time interval of 10 s and the measured bore pressure signal trace may cover a time interval of 9 s). In the example shown in FIG. 3, the measured annulus pressure signal trace should at least be as long as the two-way travel time of the information signal. Also, the signal traces of the measured annulus pressure signal and the measured bore pressure signal should include the relevant pressure variation pattern that lead to the peaks in the correlation 302.

As shown, the cross-correlation 302 includes a detection of a first annulus signal 224 (i.e., the up travelling wave) at a first time shift $\tau_1$, indicated by a first peak 308 in the cross-correlation 302, and detection of a second annulus signal 226 (i.e., the down travelling wave) at a second time shift $\tau_2$, indicated by a second peak 310 in the cross-correlation 302. The difference between the first time shift $\tau_1$ of the first peak 308 of the cross-correlation 302 and the second peak 310 of the cross-correlation 302 represents a two-way travel time $T_0$. The two-way travel time $T_0$ can then be used to determine the time delay from a transmission of an information signal at a pulser located downhole to receipt of the information signal at the surface (i.e., transmit time TX). To detect the first and second annulus signals 224, 226, the pressure sensor module, or a computing system connected thereto (e.g., a controller), monitors the pressure in the drilling fluid within both the bore of the drill string and the annulus and monitors for a pressure signal within the annulus that matches or correlates to a signal that is transmitted within the bore of the drill string to the surface (e.g., an information signal as described above).

Figure 4:
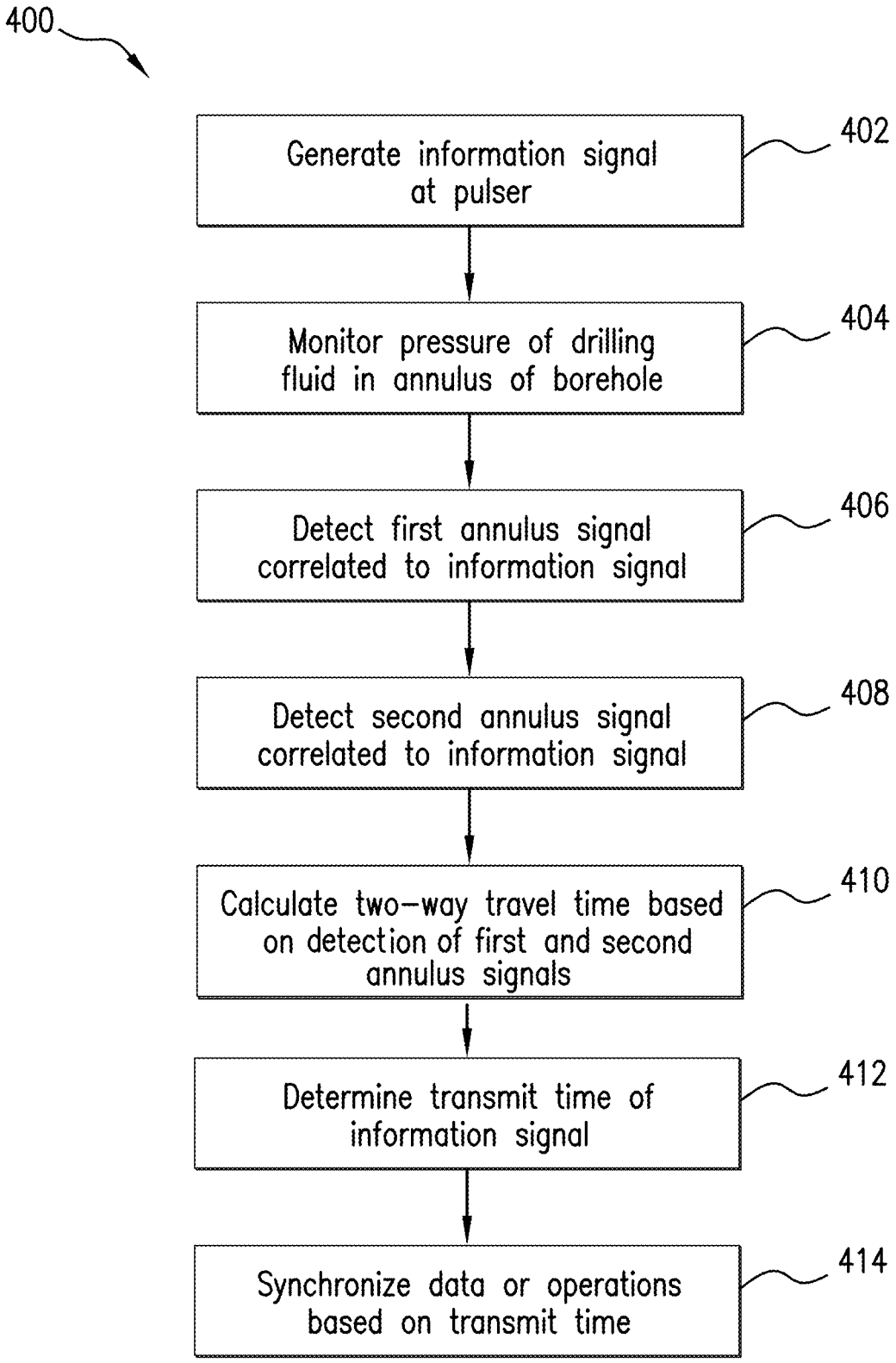
FIG. 4 is a flow process for performing an operation in accordance with an embodiment of the present disclosure.

Turning now to FIG. 4, a flow process 400 for performing synchronization and time adjustment in downhole operations is shown. The flow process 400 may be performed using a system such as that shown and described above. The flow process 400 may be performed, at least in part, using a pulser and a pressure sensor located downhole in a borehole, with an annulus formed around a drill string, with the pulser and the pressure sensor located along the drill string. In some embodiments, various aspects of the flow process 400 may be performed downhole within a bottomhole assembly and/or performed at the surface using one or more controllers or other processing equipment as will be appreciated by those of skill in the art.

At block 402, a pulser is used to generate an information signal. The information signal is a sequence of pressure pulses that are transmitted from the pulser to the surface through the interior of the drill string (drill string bore 223). The pressure pulse passes through drilling fluid that is pumped downward within the drill string to drive and/or aid in operation of a disintegrating device (e.g., drill bit). The information signal can include formation data that is collected downhole and/or other data associated with a downhole operation and/or the bottomhole assembly, also referred to as payload data. In some embodiments, the information signal may be a calibration signal that is transmitted from the pulser and thus may not include any additional information. That is, the information signal may be a pulse signal that is employed solely to determine the delay (transmit time) in receipt of telemetry data at the surface. However, as noted, in some embodiments, the information signal can include data or other information therein. Thus, the described and disclosed information signals of the present disclosure are not limited to a specific configuration of information signal, but rather may be configured for different operations as desired.

At block 404, a pressure sensor monitors the pressure of the drilling fluid within the annulus of the borehole, external to the drill string. In some embodiments, the pressure sensor may be arranged to monitor fluid pressure in both the annulus of the borehole (annulus pressure sensor) and within the bore of the drill string (bore pressure sensor). The pressure sensor may be located proximate the pulser or may be located at a different location/position along the drill string.

At block 406, a first annulus signal that is correlated to or otherwise associated with the information signal is detected. That is, when the information signal is generated at the pulser, the pressure waves will be transmitted both uphole through the drill string bore (to convey information to the surface) and will also travel downhole through the drill string and then out of the drill string at the end thereof (e.g., at a drill bit or other device) and will then travel uphole through the annulus of the borehole. When the pressure waves of the information signal travel through the annulus they may be detected by the annulus pressure sensor as a first measured annulus pressure signal. Processing of the data collected by the annulus pressure sensor can be performed to monitor for and cross-correlate a detected annulus signal that matches with the information signal. The information signal used for the correlation is detected by the bore pressure sensor that detects the bore signal. The bore signal is considered to be representative for the information signal. The detection of the first annulus signal can include a time stamp or a time shift.

At block 408, a second annulus signal that is correlated to or otherwise associated with the information signal is detected. The second annulus signal is essentially the same signal as the first annulus signal, but traveling in the opposite direction. The second annulus signal is generated by interaction of the first annulus signal with the fluid surface (e.g., fluid top at the earth's surface) and a reflection of the pressure wave down the annulus of the borehole. Processing of the data collected by the annulus pressure sensor can be performed to monitor for and cross-correlate a detected annulus pressure signal with the information signal (bore signal). The detection of the second annulus signal can include a time stamp or a time shift.

The detection of the first and second annulus signals, at blocks 406, 408, may employ various identification and/or detection processes. The detection is based on a comparison of a pressure signal detected within the annulus (annulus signal) against a pressure signal that was detected within the bore of the drill string (i.e., bore signal or the information signal). Cross-correlation may be employed for the annulus and bore signals to find a first correlation peak and a second correlation peak. The correlation peaks may be inverted (i.e., +ve and −ve; or −ve and +ve) as illustrated in FIG. 3. In an alternate embodiment, auto-correlation of the annulus signal may be employed. In such system, a single peak (−ve) at a time-offset corresponding to the time delay may be auto-detected. The references +ve and −ve stand for the correlation and inverse correlation. The annulus signal is inverted when reflected at the fluid top. The fluid top is a fluid boundary and represents a medium change and causes an inverted pressure wave, resulting in a second peak in the correlation to be inverted.

At block 410, a two-way travel time is calculated based on the detection of the first annulus signal and the second annulus signal. For example, based on the time stamps or the time shift of the detections, a travel time of the pressure wave through the drilling fluid in the annulus of the borehole between the annulus pressure sensor, to the surface, and back to the annulus pressure sensor, can be calculated, measured, or determined. The determination of the two-way travel time may be performed downhole, e.g., within a sensor sub and/or part of a bottomhole assembly, or may be performed at the surface, with the time stamps or the time shift transmitted within an information signal (or other data signal sent from the pulser).

At block 412, based on the two-way travel time, a transmit time of the information signal is determined. The transmit time is a time delay between transmission of the information signal from the pulser and receipt of the information signal at the surface pressure sensor. The transmit time is about the same as half the two-way travel time, within margins of error. It is noted that some variation in travel time of pressure waves through the drilling fluid may occur, in comparing the speed of travel through the bore of the drill string and within the annulus. For example, changes in fluid density, fluid temperature, fluid compression, and/or fluid composition may impact the speed of the pressure pulse in the annulus as compared to the speed of the pressure pulse within the bore of the drill string. Further, the fluid surface, that causes the reflection of the annulus signals, may be at a slightly different position or location than a pressure sensor or other device that receive telemetered signals from the pulser (i.e., that receive the information signal). However, such variations and/or differences are within margins of error, and thus do not impact, or substantially do not impact, the determined transmit time. That is, the measured transmit time as calculated in accordance with the present disclosure is substantially more accurate and precise than prior methods of "estimation" based on guessing depth and fluid properties.

At block 414, based on the determined transmit time, formation and/or BHA data and/or operations can be synchronized and/or adjusted. That is, knowing the transmit time, operators or systems can be informed of a time (and/or location) of data collected and/or transmitted from downhole (at the pulser). For example, by using the time of data collected that is corrected for the travel time of the signals in the mud, to determine the depth of data collected produces more accurate results. That is, the determination of depth of data collected is more accurate and consequently depth-based information, such as depth-based logs of formation evaluation data, is more accurate.

It is noted that the pressure wave generated by the information signal may traverse the annulus multiple times. That is, the pressure wave may travel up the borehole to the fluid top, reflect, and travel back down the borehole, where it will reflect again at the bottom of the borehole, and travel upward again. The repeated reflections can be detected to obtain multiple measurements of the two-way travel time and thus of the transmit time. Accordingly, a more accurate or representative transmit time may be determined. The measured annulus pressure signal is a superposition of the multiple annulus signals traveling through the annulus up and down.

In addition to the above process for determining a transmit time, embodiments of the present disclosure can be used to determine features of the borehole and drilling process. For example, gas in the drilling fluid can alter the wave speed (e.g., of the annulus signals) and attenuate the signal. Based on the wave speed that causes a signal speed and a time delay and/or the attenuation, it can be determined if a borehole influx (e.g., a borehole gas influx or 'kick') is present. For example, in one illustrative embodiment, the signal speed, the time delay, and/or the attenuation can be monitored. In addition, depth and environmental temperature may be measured. If a change in signal speed, time delay, and/or attenuation is observed, that is not caused by a depth increase of the drill bit or by a change of the environmental temperature, a conclusion can be made that the drilling fluid may have changed its composition. The conclusion that the drilling fluid may have changed its composition may trigger a message or alarm to a processing unit or a human operator that in turn may change an operation parameter. For example, in response to such a message (or alarm), the drilling process may be changed (e.g., stopped), the drilling fluid composition may be changed, or safety measurements, as known in the art, may be taken to avoid potential damage that may be caused by the borehole influx. In another illustrative example, if the time delay is determined by the methods described herein, and the depth is known, the compressibility of the drilling fluid may be estimated which in turn is important for kick detection or well killing.

Accordingly, embodiments described herein can be used for multiple purposes, and are not limited to transmit time determination only. In another example, if the transmission velocity in the drilling fluid is known, the measured time delay or transmit time can be used to estimate depth (e.g., measured depth or along-string depth) of the pressure sensor used for the measurement of the transmit time and, thus, the depth of the well may be estimated. In accordance with some embodiments, the estimation of the depth can be done downhole to provide downhole data to the BHA. Knowing the depth downhole enables for automated downhole drilling decisions to be performed by a controller in the BHA located downhole. An automated downhole drilling decision may be an automated downhole control of a preprogrammed drilling trajectory. The downhole depth is the measured depth (MD).

Advantageously, some embodiments described herein provide for methods and systems for determining time delay in telemetry systems during downhole operations (e.g., drilling). The time delay can be accurately measured to determine the amount of time between a telemetry data transmission and detection of such transmission at the surface. Accordingly, time synchronization and/or correction can be achieved accurately. Such embodiments improve over prior systems that estimated the travel time, but did not measure such travel time. Further, advantageously, embodiments provided herein can enable determination of a kick or borehole influx based on attenuation of pressure signals (e.g., the annulus signals described herein).

Further, in some embodiments of the present disclosure, systems may employ reflectors in the annulus other than the surface of the fluid 218. Such devices may serve to place a reflector a known distance from the pressure sensors so that the travel time can be estimated over a known distance for the measurement of such parameters as fluid properties, drill string stretch, etc., which are of interest during drilling. Further, while the information signal from the pulser is a series of random or pseudo-random information symbols, it is possible to generate a sequence that is random, providing a random information signal. The advantage of such a random information signal is that it may have excellent auto-correlation and cross-correlation properties, enabling detection of the up-travelling and down-traveling waves in the annulus, even in the presence of significant noise.

If deploying a random information signal, in accordance with some embodiments of the present disclosure, the pulser may create a random information signal (random pressure pulses) only for the purpose to determine the transmit time. The random information signal may be based on a random signal provided by a processor to the pulser. The creation of the random information signal may be performed by the pulser intermittently with the transmission of the payload data. Alternatively, the random information signal may be transmitted at the same time as the payload data (superposed). As the random information signal leads to a strong correlation when correlating the pressure sensor data, the correlation associated with the random information data superposed to the payload data is clearly to be identified. The correlation peak has a larger amplitude or the correlation coefficient is closer to one compared with correlation peaks resulting from the correlation of information data based on payload data (e.g., FE data, MWD data).

Further, while embodiments described herein have focused on the wave traveling in the annulus, the same measurement can be made within the bore of the drill string, using a pressure measurement made within the bore of the drill string, if a reflection occurs at or close to the fluid boundary at the surface.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Embodiment 1: A method for performing a borehole operation comprising: generating an information signal in a borehole using a pulse generation member, wherein the information signal comprises a pressure variation within a borehole fluid; detecting, in the borehole, a first signal that correlates to the information signal at a first time; detecting, in the borehole, a second signal that correlates to the information signal at a second time; and performing a borehole operation using the first signal and the second signal.

Embodiment 2: The method of any of the above embodiments, wherein the first signal and the second signal are detected by a pressure sensor in the borehole fluid.

Embodiment 3: The method of any of the above embodiments, wherein using the first signal and the second signal comprises estimating data indicative of a transmit time.

Embodiment 4: The method of any of the above embodiments, wherein using the estimating comprises a mathematical correlation.

Embodiment 5: The method of any of the above embodiments, further comprising transmitting the data indicative of the transmit time to a surface location.

Embodiment 6: The method of any of the above embodiments, wherein the borehole operation comprises adjusting a time stamp based on the data indicative of the transmit time.

Embodiment 7: The method of any of the above embodiments, wherein the time stamp is associated to formation evaluation data measured by a formation evaluation sensor in the borehole.

Embodiment 8: The method of any of the above embodiments, further comprising synchronizing a plurality of borehole operations based on the data indicative of the transmit time.

Embodiment 9: The method of any of the above embodiments, wherein the pulse generation member is included in a downhole assembly and at least one of the first signal and the second signal is detected in an annulus that is formed between the borehole and the downhole assembly.

Embodiment 10: The method of any of the above embodiments, further comprising estimating, by a processor in the downhole assembly, a depth based on the first signal and the second signal.

Embodiment 11: The method of any of the above embodiments, further comprising determining a two-way travel time based on the detection of the first signal and the detection of the second signal.

Embodiment 12: The method of any of the above embodiments, wherein the information signal comprises one of formation evaluation data and measurement-while-drilling data.

Embodiment 13: The method of any of the above embodiments, wherein the borehole operation comprises detecting a borehole influx based on the first signal and the second signal.

Embodiment 14: The method of any of the above embodiments, wherein the second signal is a reflected signal of the first signal that reflects at a reflector in the borehole.

Embodiment 15: A downhole system for performing a downhole operation, the downhole system comprising: a downhole assembly disposed in a borehole; a pulse generation member disposed on the downhole assembly and configured to generate an information signal, wherein the information signal comprises a pressure variation within a borehole fluid; a pressure sensor arranged on the downhole assembly and configured to detect a first signal that correlates to the information signal at a first time and a second signal that correlates to the information signal at a second time; and a processor configured to estimate data indicative of a transmit time, the data indicative of the transmit time estimated by using the first signal and the second signal.

Embodiment 16: The downhole system of any of the above embodiments, wherein at least one of the first signal and the second signal is detected in an annulus that is formed by the borehole and the downhole assembly.

Embodiment 17: The downhole system of any of the above embodiments, further comprising a surface unit located at a surface location, the surface unit configured to adjust a time stamp based on the data indicative of the transmit time.

Embodiment 18: The downhole system of any of the above embodiments, wherein the drilling assembly comprises a formation evaluation sensor and the time stamp is associated to formation evaluation data measured by the formation evaluation sensor.

Embodiment 19: The downhole system of any of the above embodiments, wherein the information signal comprises one of formation evaluation data and measurement-while-drilling data.

Embodiment 20: The downhole system of any of the above embodiments, wherein the second signal is a reflected signal of the first signal that reflects at a reflector in the borehole.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device.

The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/ or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" or "substantially" used in connection with a quantity is inclusive of the stated value and has the meaning dictated by the context (e.g., it includes the degree of error associated with measurement of the particular quantity). For example, the phrase "substantially constant" is inclusive of minor deviations with respect to a fixed value or direction, as will be readily appreciated by those of skill in the art.

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure. It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling fluids, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for performing a borehole operation comprising:

generating an information signal in a borehole using a pulse generation member, wherein the information signal comprises a pressure variation within a borehole fluid;

detecting, in the borehole, at least a portion of the information signal at a first time to provide a first signal;

detecting, in the borehole, at least a portion of the information signal at a second time to provide a second signal; and performing the borehole operation using the first signal and the second signal, wherein the information signal comprises one of formation evaluation data and measurement-while-drilling data.

2. The method of claim 1, wherein the information signal is detected by a pressure sensor in the borehole fluid.

3. The method of claim 1, wherein using the first signal and the second signal comprises estimating data indicative of a transmit time.

4. The method of claim 3, wherein the estimating comprises a mathematical correlation of the first signal and the second signal to determine a time shift.

5. The method of claim 3, further comprising transmitting, using the pulse generation member, the data indicative of the transmit time to a surface location.

6. The method of claim 3, wherein the borehole operation comprises adjusting a time stamp of downhole data based on the data indicative of the transmit time.

7. The method of claim 6, wherein the downhole data comprises formation evaluation data measured by a formation evaluation sensor in the borehole.

8. The method of claim 3, further comprising synchronizing a plurality of borehole operations based on the data indicative of the transmit time.

9. The method of claim 1, further comprising determining a two-way travel time based on the first signal and the second signal.

10. The method of claim 1, wherein the borehole operation comprises detecting a borehole influx based on the first signal and the second signal.

11. The method of claim 1, wherein the second signal is indicative of the at least a portion of the information signal detected at the second time and reflected at a reflector in the borehole.

12. A downhole system for performing a downhole operation, the downhole system comprising:

a downhole assembly disposed in a borehole;

a pulse generation member disposed on the downhole assembly and configured to generate an information signal, wherein the information signal comprises a pressure variation within a borehole fluid;

a pressure sensor arranged on the downhole assembly and configured to detect a first signal that correlates to the information signal at a first time and a second signal that correlates to the information signal at a second time; and a processor configured to estimate data indicative of a transmit time, the data indicative of the transmit time estimated by using the first signal and the second signal.

13. The downhole system of claim 12, wherein at least one of the first signal and the second signal is detected in an annulus that is formed by the borehole and the downhole assembly.

14. The downhole system of claim 12, further comprising a surface unit located at a surface location, the surface unit configured to adjust a time stamp based on the data indicative of the transmit time.

15. The downhole system of claim 14, wherein the downhole assembly comprises a formation evaluation sensor and the time stamp is associated to formation evaluation data measured by the formation evaluation sensor.

16. The downhole system of claim 12, wherein the information signal comprises one of formation evaluation data and measurement-while-drilling data.

17. The downhole system of claim 12, wherein the second signal is indicative of at least a portion of the information signal detected at the second time and at a reflector in the borehole.

18. A method for performing a borehole operation comprising:

generating an information signal in a borehole using a pulse generation member, wherein the information signal comprises a pressure variation within a borehole fluid;

detecting, in the borehole, a first signal that correlates to the information signal at a first time;

detecting, in the borehole, a second signal that correlates to the information signal at a second time;

estimating, by a processor in a downhole assembly, a depth based on the first signal and the second signal; and performing the borehole operation using the first signal and the second signal.

19. The method of claim 18, wherein using the first signal and the second signal comprises estimating data indicative of a transmit time.

20. A method for performing a borehole operation comprising:

generating an information signal in a borehole using a pulse generation member, wherein the information signal comprises a pressure variation within a borehole fluid;

detecting, in the borehole, at least a portion of the information signal at a first time to provide a first signal;

detecting, in the borehole, at least a portion of the information signal at a second time to provide a second signal; and performing the borehole operation using the first signal and the second signal;

wherein the pulse generation member is included in a downhole assembly and the information signal is detected in an annulus that is formed between the borehole and the downhole assembly.

21. The method of claim 20, wherein the information signal is detected in the borehole fluid by a pressure sensor.

22. The method of claim 20, wherein using the first signal and the second signal comprises estimating data indicative of a transmit time and adjusting a time stamp of downhole data based on the data indicative of the transmit time.

* * * * *